US009188959B2

(12) United States Patent
Bertrand et al.

(10) Patent No.: US 9,188,959 B2
(45) Date of Patent: Nov. 17, 2015

(54) WATCH CASE WITH ORIENTABLE AND INDEXED BEZEL

(71) Applicant: MONTRES TUDOR S.A., Geneva (CH)

(72) Inventors: Jean-Louis Bertrand, Feigeres (FR); Frederic Mossiere, Cercier (FR); Gregory Schmidt, Pougny (FR); Jerome Tyrode, Gaillard (FR)

(73) Assignee: MONTRES TUDOR S.A., Geneva (CH)

( * ) Notice: Subject to any disclaimer, the term of this patent is extended or adjusted under 35 U.S.C. 154(b) by 0 days.

(21) Appl. No.: 13/759,710

(22) Filed: Feb. 5, 2013

(65) Prior Publication Data

US 2013/0201804 A1 Aug. 8, 2013

(30) Foreign Application Priority Data

Feb. 6, 2012 (EP) ..... 12405018

(51) Int. Cl.

| | |
|---|---|
| ***G04B 19/22*** | (2006.01) |
| ***G04B 39/00*** | (2006.01) |
| ***G04B 19/28*** | (2006.01) |
| ***G04B 19/18*** | (2006.01) |
| *G04B 37/00* | (2006.01) |

(52) U.S. Cl.

CPC ..... *G04B 19/283* (2013.01); *G04B 19/18* (2013.01); *G04B 19/22* (2013.01); *G04B 19/223* (2013.01); *G04B 19/225* (2013.01); *G04B 37/0008* (2013.01)

(58) Field of Classification Search

CPC ..... G04B 19/18; G04B 19/22; G04B 19/223; G04B 19/225

USPC ..... 368/21, 22, 294, 295

See application file for complete search history.

(56) References Cited

U.S. PATENT DOCUMENTS

| | | | | | |
|---|---|---|---|---|---|
| 3,271,945 | A | * | 9/1966 | Anderson | 368/22 |
| 5,122,997 | A | * | 6/1992 | Schneider et al. | 368/294 |
| 5,319,617 | A | * | 6/1994 | Sonoda | 368/294 |
| 5,541,895 | A | * | 7/1996 | Nussbaum | 368/295 |

(Continued)

FOREIGN PATENT DOCUMENTS

| | | |
|---|---|---|
| CH | 498436 A | 7/1970 |
| CH | 328869 D | 10/1972 |

(Continued)

OTHER PUBLICATIONS

European Search Report of EP12405018.8, mailing date of Sep. 9, 2012.

*Primary Examiner* — Amy Cohen Johnson
*Assistant Examiner* — Daniel Wicklund
(74) *Attorney, Agent, or Firm* — Westerman, Hattori, Daniels & Adrian, LLP

(57) ABSTRACT

A watch case (9; 19; 29) has a middle (2; 12; 22), a bezel (3; 13; 23) mounted to turn on the middle, a ring (5; 15; 25) interfacing between the middle and the bezel, and a first indexing element (1; 11) and a second indexing element (3*a*; 13*a*; 23*a*) which collaborate in such a way as to index the bezel in position relative to the middle, a first elastic element (4*b*, 4*c*, 4*d*; 15; 25) pressing the bezel against the middle and a second elastic element (4*a*) pressing the first indexing element against the second indexing element (3*a*; 13*a*; 23*a*), the ring comprising an opening (5*a*; 15*a*) through which the first or the second indexing element is arranged.

25 Claims, 4 Drawing Sheets

(56) References Cited

U.S. PATENT DOCUMENTS

| | | | | |
|---|---|---|---|---|
| 6,579,004 | B1 * | 6/2003 | Kim | 368/295 |
| 2004/0141424 | A1 * | 7/2004 | Hartmann et al. | 368/295 |
| 2005/0007890 | A1 | 1/2005 | Bertrand et al. | |
| 2008/0049562 | A1 * | 2/2008 | Andren et al. | 368/295 |
| 2008/0056070 | A1 * | 3/2008 | Lin | 368/21 |
| 2008/0273428 | A1 * | 11/2008 | Damasko | 368/295 |

FOREIGN PATENT DOCUMENTS

| | | | | |
|---|---|---|---|---|
| CH | 536509 | A | 10/1972 | |
| CH | 631592 | A | 8/1982 | |
| CH | 690254 | A5 | 6/2000 | |
| EP | 686897 | A1 | 12/1995 | |
| EP | 1416341 | A2 | 5/2004 | |
| JP | 61-176474 | U | 11/1986 | |
| WO | WO 9745775 | A1 * | 12/1997 | G04B 19/28 |

* cited by examiner

WATCH CASE WITH ORIENTABLE AND INDEXED BEZEL

The invention relates to a watch case (or watch casing), notably a case with a rotary (or orientable) and indexed bezel. The invention also relates to a watch, particularly a wrist watch, comprising such a case.

Numerous embodiments of case devices with a bezel that is rotary and toothed or notched or indexed in one direction or both directions are known. These devices mainly seek to minimize and/or to simplify the components needed for fitting such a bezel. To a lesser extent, some devices are aimed at optimizing the sensation felt when turning the bezel.

Document CH631592 discloses a watch case with a rotary and toothed or notched bezel in which the cross section of an annular seat of a watch middle is particularly small. The bezel is mounted on a ring secured to the annular seat of the middle. This comprises two flexing leaves which are positioned on one and the same radius and are inclined with respect to the plane of the rotary bezel so as to collaborate with an edge toothset formed on an underside of the bezel. Thus, this ring, through the agency of its two flexing leaves, simultaneously angularly indexes the bezel and holds it in position by urging the bezel elastically against the middle. The detent function or the function of indexing the bezel is therefore dependent on the frictional torque applied by the ring, and the frictional torque cannot be optimized to improve the sensation felt when turning the bezel without adversely affecting the detent function. Furthermore, the vertical location and centering of the bezel with respect to the case are defined through just one single set of projections formed respectively on the middle and on the bezel. Thus, it is not possible to adjust the vertical position of the bezel in order to regulate the frictional torque without influencing the centering of the bezel. Finally, because of the numerous bending operations performed on the circumference of the ring, the sensation felt by the user when turning the bezel is particularly dependent on the way in which this bezel is handled, and notably on the intensity of axial pressure applied to it and the way in which this pressure is distributed.

In order to alleviate these disadvantages, at least partially, one solution that is known among some products on the market is to use a ring that has two distinct sets of flexing leaves. This embodiment can be differentiated through the fact that a first set of flexible blades is devoted to the angular indexing of the bezel by collaborating with the interior toothset thereof, and that a second set of flexible blades is able to generate the desired frictional torque by urging the bezel elastically against a projection formed on the middle. This solution has the advantage of separating the detent function from the braking function but, in order to do so, requires an annular cross section that is large enough to accommodate each of the sets of flexible blades on two separate radii. Thus, the look of the watch case is dependent on the solution. Further, just as with the solution set out in document CH631592, there is no possibility of adjusting the frictional torque without influencing the centering of the bezel, and the sensation felt by the user when turning the bezel is particularly dependent on the way in which this bezel is handled.

One solution that allows the frictional torque applied to the bezel to be particularly uniform and adjustable independently of the centering of the bezel is set out in document EP1416341A1. The latter describes a rotary bezel which is centered and held in position on the middle via ball bearings pressed in a direction perpendicular to the plane of the bezel by helical springs in a runway track formed on the underside of the bezel. Such a solution at least partially overcomes the disadvantages of the abovementioned designs. However, the annular cross section of the underside of this bezel does not allow the detent function to be added to the function of maintaining the angular positioning of the bezel.

It is an object of the invention to provide a watch case that is able to overcome the aforementioned disadvantages and improve watch cases known from the prior art. In particular, the invention proposes a watch case that makes it possible independently to adjust the functions of the friction of the bezel on the middle and the indexing of the bezel relative to the middle while at the same time maintaining small cross sections for the middle and for the bezel, and in particular making it possible to maximize the ratio of the outside diameter of the glass to the overall diameter of the middle.

A watch case according to the invention is defined by claim 1.

Various embodiments of a watch case according to the invention are defined by claims 1 to 14.

In these various embodiments, a ring and/or a middle may comprise an immobilizing element preventing the ring from turning relative to the middle. The immobilizing element may comprise a lug on the ring collaborating with a recess in the middle. Alternatively, the immobilizing element may comprise a lug in the middle collaborating with a recess in the ring.

In these various embodiments, a pawl may be positioned in a housing produced within the middle.

A watch according to the invention is defined by claim 15.

The attached drawings illustrate, by way of nonlimiting examples, three embodiments of a watch case according to the invention.

Figure 1:
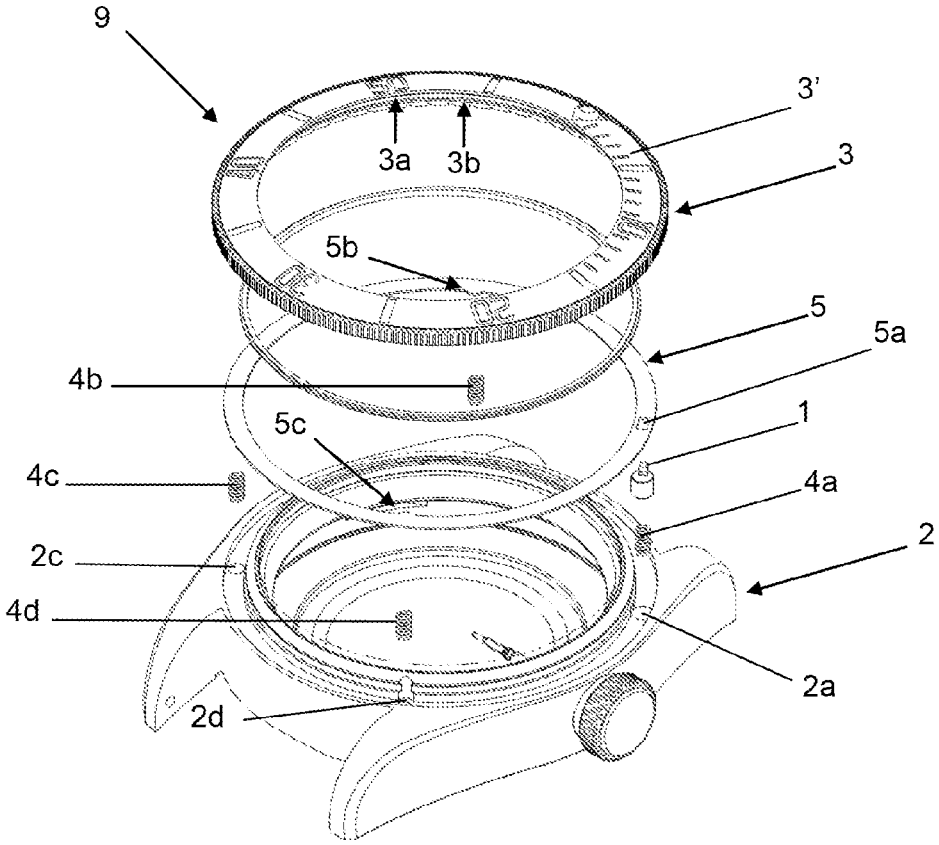
FIG. 1 is an exploded perspective view of a first embodiment of a watch case according to the invention.
Figure 2:
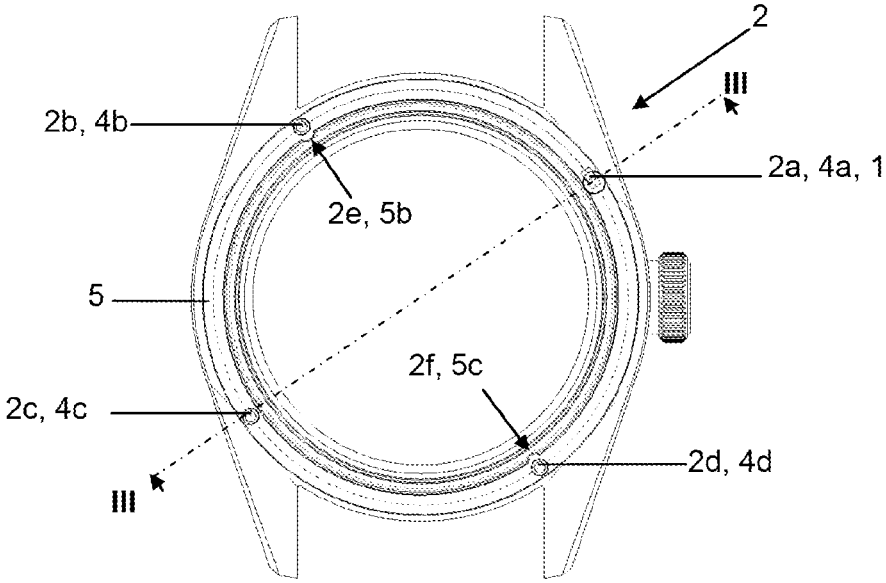
FIG. 2 is a front view of a watch middle used in the first embodiment of the watch case according to the invention.
Figure 3:
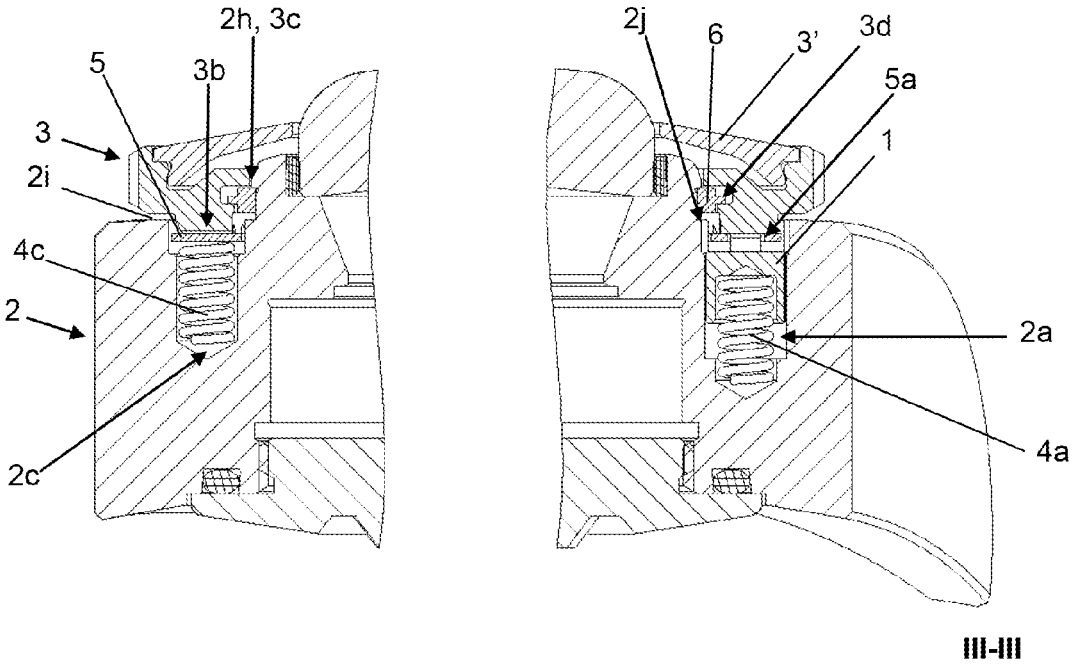
FIG. 3 is a view in partial section on the plane III-III of FIG. 2 of the first embodiment of the watch case according to the invention.

A first embodiment of a watch case 9 is described hereinafter with reference to FIGS. 1 to 4.

The watch case 9 comprises:

- a middle 2,
- a bezel 3 mounted to turn on the middle,
- a ring 5 interfacing between the middle and the bezel, and
- a first indexing element 1 and a second indexing element 3*a* which collaborate in such a way as to index the bezel in position relative to the middle.

The watch case further comprises a first elastic element 4*b*, 4*c*, 4*d* pressing the bezel against the middle in such a way as to create friction between the middle and the bezel, and a second elastic element 4*a* pressing the first indexing element 1 against the second indexing element 3*a*. The ring comprises an opening 5*a* through which the first indexing element is arranged.

To allow the bezel to turn on the middle, the bezel and middle are connected by a pivot connection produced by an inside diameter 3*c* of the bezel that surrounds an outside diameter 2*h* of the middle. Moreover, the bezel and middle are stopped relative to one another along the axis of rotation of the bezel, in a first direction, by contact of the bezel against the middle via the ring 5 and, in the other direction, by virtue of a retaining ring or snap ring 6 mounted both in a groove 2*j* of the middle and in a groove 3*d* of the bezel.

As explained previously, means create friction between the bezel and the middle as the bezel turns on the middle, i.e. ensure that there is a mechanical torque of determined intensity resisting the turning of the bezel on the middle. Moreover, as explained previously, means provide a function of indexing the positions of the bezel relative to the middle. This indexing function can be characterized by a mechanical torque that has to be overcome in order to move the bezel with respect to the middle between two successive indexing positions and/or by a mechanical retaining torque that keeps the bezel stationary relative to the middle. The elements described in further detail hereinafter and which perform these two functions also allow these two functions to be independent of one another in a small amount of space.

The first indexing element comprises a pawl 1 which is pressed in a direction perpendicular to the plane of the bezel by the second elastic element comprising a helical spring 4*a*. The second indexing element comprises teeth or an edge toothset 3*a* formed on an underside 3*b* of the bezel 3. Thus, the pawl and the toothset collaborate to perform indexing, each hollow between two successive teeth defining a position in collaboration with the pawl when the latter is between the two teeth. The pawl is returned against the toothset by the second elastic element.

Advantageously, the pawl 1 and the spring 4*a* are housed within a cutout or housing 2*a* produced on an annular seat 2*i* of the middle 2. The housing is, for example, a cylindrical bore in which the pawl slides freely. The spring may bear against the bottom of the housing and under the pawl. The head of the pawl is configured to interact with the toothset. It may, for example, have a triangular profile that complements the hollowed profiles present between two successive teeth. The two flanks of the head of the pawl may have different gradients so that one gradient allows the bezel to turn in a first direction and the other gradient prevents the bezel from turning in the second direction. Thus, the geometries of the pawl 1 and of the toothset 3*a* can be defined in such a way as to generate one-way or two-way detent mechanism so as to adapt to suit the functionality of the wrist watch and the information indicated by the disk 3' attached to the bezel 3.

Figure 4:
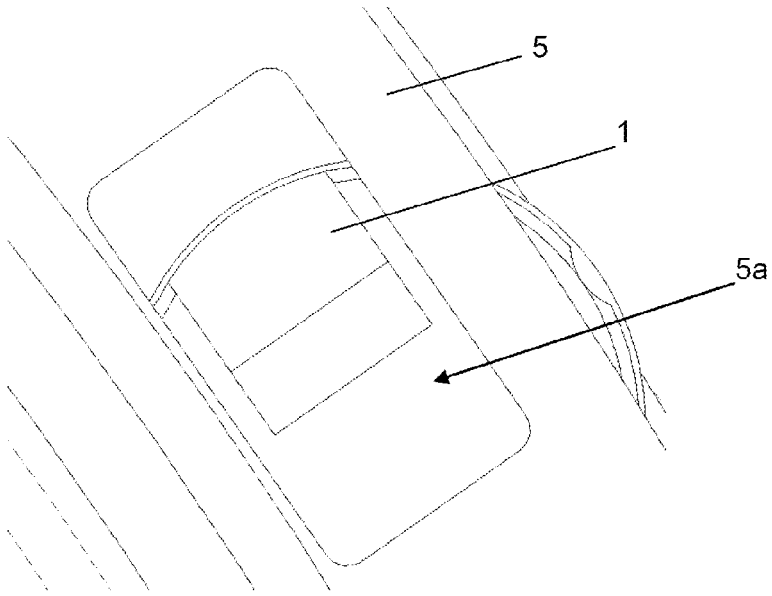
FIG. 4 is a detailed front view of the middle at an indexing element that indexes the bezel relative to the middle.

As seen earlier, a ring 5 is interposed between the bezel and the middle and this ring has the opening 5*a* that allows the pawl, particularly the head of the pawl, to pass through the ring to collaborate with the toothset. Advantageously, the opening has a shape that complements or at least partially complements the cross section of the head of the pawl (perpendicular to the axis of the bore 2*a*) and that prevents the pawl from rotating about the axis of the bore. For example, the opening may have a rectangular shape as depicted in FIG. 4. Thus, the cutout 5*a* formed on the ring 5 also has the advantage of angularly indexing the pawl 1 relative to the toothset 3*a* of the underside 3*b* of the bezel 3. This arrangement allows the machining of the pawl 1 to be simplified as much as possible. Notably, the pawl may be a cylinder of revolution overall and fit into a bore 2*a* that is a cylinder of revolution.

The opening 5*a* may also open onto the inside diameter or onto the outside diameter of the ring 5.

The architecture of the components may be reversed, the pawl being housed in the bezel and the toothset secured to the middle.

The first indexing element, the second indexing element and the second elastic element perform the indexing function mentioned above.

The first elastic element 4*b*, 4*c*, 4*d* presses the bezel against the middle. More specifically, the first elastic element bears against the middle and presses the ring 5 against the bezel, the latter being pressed against the retaining ring 6 which is itself pressed against the middle.

The first elastic element may comprise several springs, notably one, two, three, four helical springs 4*b*, 4*c*, 4*d*, or even more than four helical springs. The springs are each housed in a cutout or housing 2*b*, 2*c*, 2*d* made on the annular seat 2*i* of the middle 2. The housing is, for example, a cylindrical bore in which the spring can deform freely. The spring can bear against the bottom of the housing and against an underside of the ring.

Advantageously, in order to limit the space occupied on the middle, the housings 2*b*, 2*c*, 2*d* are created on the same radius or substantially on the same radius, centered on the axis of rotation of the bezel relative to the middle. The housing 2*a* is preferably also centered on this radius or substantially on this radius. As a further preference, these various housings are angularly distributed such that they are substantially equidistant.

The ring and/or the middle comprise an immobilizing element 2*e*, 2*f*; 5*b*, 5*c* that prevents the ring from turning relative to the middle. For example, the immobilizing element comprises a lug 5*b*, 5*c* on the ring collaborating with a recess 2*e*, 2*f* in the middle.

As an alternative, the immobilizing element comprises a lug in the middle collaborating with a recess in the ring.

Thus, when the bezel is turned, it rubs, at the tops of the teeth 3*a*, against the ring 5. It also rubs against the retaining ring (or the retaining ring rubs against the middle). This rubbing or friction occurs with the bezel being pressed against the middle giving rise to friction forces that generate a mechanical frictional torque that opposes the turning of the bezel.

The first elastic element and the ring perform the friction function mentioned earlier.

In particular, the ring and its opening allow the indexing and friction functions to be separated. The operating parameters of these functions can thus be set independently of one another.

Thus, it is possible to mount the bezel to turn on the middle with a frictional torque which is particularly uniform through the interposition of the springs and of the ring that forms the interface between the middle and the underside of the bezel. The centering of the bezel is also guaranteed independently of its vertical positioning: the bezel 3 is centered via its inside diameter 3*c* which is configured to collaborate with the portion 2*h* of the middle 2. Its vertical retention is, for its part, defined in the conventional way via the retaining ring 6 which here is attached directly to the middle 2. Moreover, with such a case, the annular cross section of the underside of the bezel can be minimized.

Figure 5:
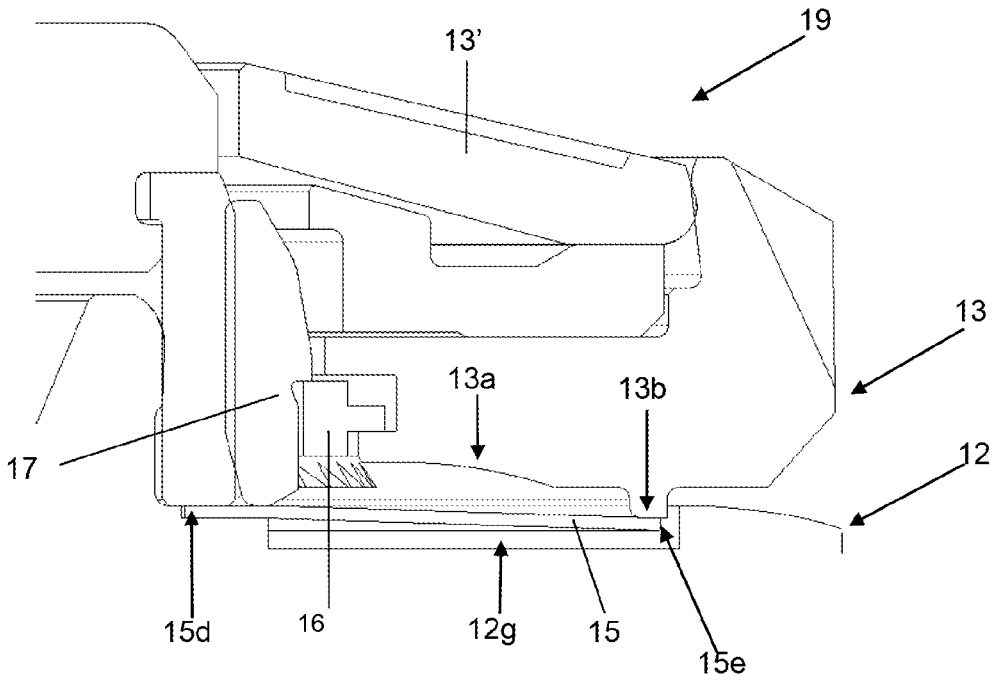
FIG. 5 is a view in partial section of a second embodiment of the watch case according to the invention.
Figure 6:
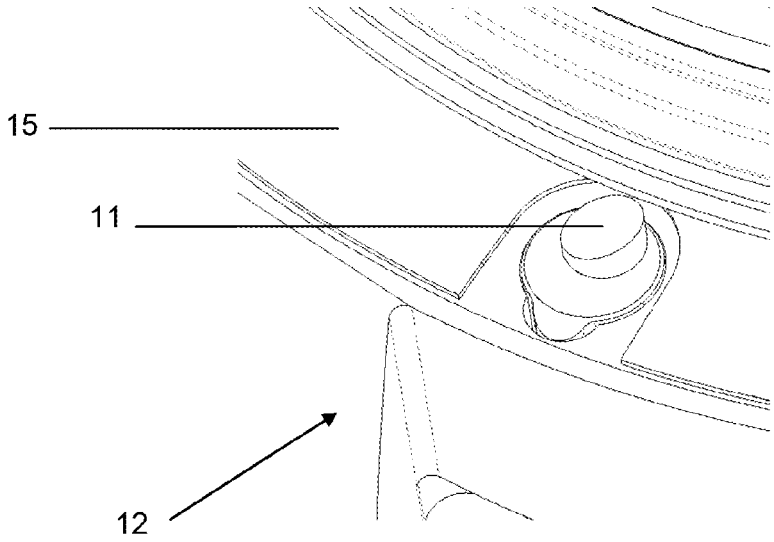
FIG. 6 is a perspective view of the middle at an indexing element that indexes the bezel relative to the middle and used in the second embodiment of the watch case according to the invention.
Figure 7:
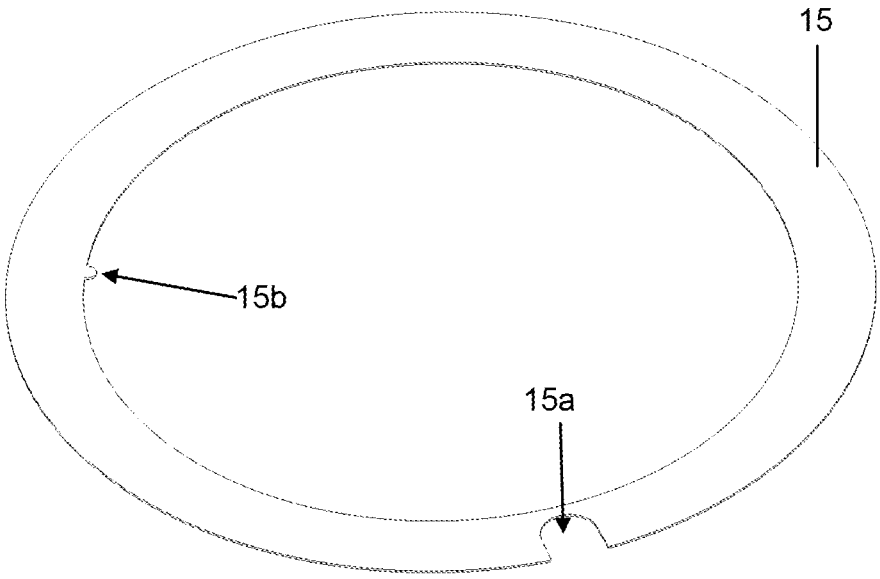
FIG. 7 is a perspective view of a ring used in the second embodiment of the watch case according to the invention.

A second embodiment of a watch case 19 is described hereinafter with reference to FIGS. 5 to 7.

In the illustrations of this second embodiment, elements which are identical, similar or perform the same function as those of the first embodiment have numerical references to which ten has been added. Thus, for example, the case and the middle in the second embodiment are referenced <<19>> and <<12>> whereas the case and the middle of the first embodiment are referenced "9" and "2". For example, as shown in FIG. 5, a disk 13' is attached to the bezel 13, which is pressed against a retaining ring 16 which is itself pressed against the middle 12.

For example, the second embodiment differs from the first embodiment only in the way in which the first elastic element is embodied.

In this second embodiment, the first elastic element consists of the ring 15 itself. The ring is a spring washer. The ring acts as a spring washer and is thus able to generate a uniform braking torque on the bezel irrespective of any additional spring. The ring is fixed to the middle at its inside diameter 15*d* and bears against the bezel at its outside diameter 15*e*. Just as in the first embodiment, the ring 15 comprises at least one immobilizing element, for example a lug 15*b*, designed to collaborate with an immobilizing element of the middle 12.

The ring 15 is pressed against part of the annular seat of the middle 12 by a retaining ring 17 at its inside diameter. The vertical location of the bezel 13 is defined by a retaining ring 16 such that once the bezel is mounted on the middle its underside 13*b* comes into contact with the ring 15, at its outside diameter 15*d*, so as to cause it to flex into a groove 12*g* provided on the annular seat of the middle. Thus, the deformation of the ring 15 allows the bezel 13 to be pressed elastically against the middle 12 via the retaining ring 16.

The frictional torque can of course be adjusted according to the thickness of the ring and its active cross section which is defined by the radial extent of the groove 12*g*.

Just as in the first embodiment, a cutout 15*a* is provided on the ring 15 so that the pawl 11, positioned in the middle 12, can come into contact with the edge toothset 13*a* which is situated on a plane distinct from the underside 13*b*.

As an alternative, the ring may be fixed to the middle or, respectively, to the bezel, at its outside diameter and may bear against the bezel or, respectively, against the middle, at its inside diameter.

Figure 8:
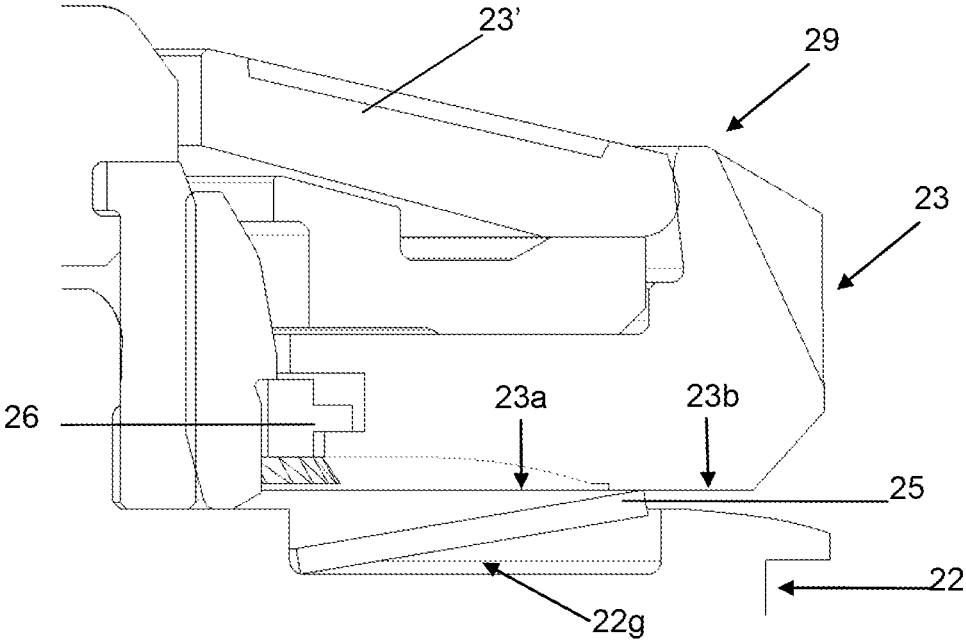
FIG. 8 is a view in partial section of a third embodiment of the watch case according to the invention.

A third embodiment of a watch case 29 is described hereinafter with reference to FIG. 8.

In the illustration of this third embodiment, the elements that are identical, similar or perform the same function as those of the first embodiment have numerical references to which two tens have been added. Thus, for example, the case and the middle in the third embodiment are referenced "29" and "22" whereas the case and the middle in the first embodiment are referenced "9" and "2". For example, as shown in FIG. 8, a disk 23' is attached to the bezel 23, which is pressed against a retaining ring 26 which is itself pressed against the middle 22.

For example, the third embodiment differs from the first embodiment solely in the way in which the first elastic element is embodied.

In this third embodiment, the first elastic element consists of the ring 25 itself. The ring acts as a spring washer and thus makes it possible to generate a uniform braking torque on the bezel independently of any additional spring. The ring 25 when unloaded is of frustoconical shape. It, for example, consists of a washer of the "Belleville" spring washer type. The ring is mounted bearing against the middle, notably in a groove 22*g*, and bearing against the bezel, notably against the underside 23*b* of the bezel. Thus, the washer can be positioned in the groove 22*g* formed on the annular seat of the middle and tensioned by the underside 23*b* of the bezel 23 which is positioned vertically in such a way as to generate the desired frictional torque on the bezel. The frustoconical geometry of the ring 25 allows the edge toothset 23*a* to be arranged on the underside 23*b* of the bezel 23. The braking torque is of course adjustable according to the thickness of the ring and the cross section thereof. As in the other embodiments, a cutout is provided on the ring 25 so that the pawl, positioned in the middle 22, can come into contact with the edge toothset 23*a*. Just as in the first two embodiments, the ring 15 comprises at least one immobilizing element, for example a lug 25*b*, designed to collaborate with an immobilizing element 22*e* of the middle 22.

As an alternative, just as in the second embodiment, the ring can be fixed to the middle or, respectively, to the bezel, at its outside diameter and can bear against the bezel or, respectively, against the middle, at its inside diameter.

The various embodiments described hereinabove can be used to create a watch, notably a wrist watch.

In the various embodiments, the ring and/or the middle may comprise an immobilizing element preventing the ring from turning relative to the middle. The immobilizing element may comprise a lug on the ring collaborating with a recess in the middle. Alternatively, the immobilizing element may comprise a lug in the middle collaborating with a recess in the ring.

In the various embodiments, a pawl may be positioned in a housing produced in the middle.

The watch case according to the invention therefore makes it possible to provide friction and indexing functions which are independent while at the same time limiting the surface area needed for implementing them, particularly the cross section of the annular seat of the middle can be minimized. The number of components needed for implementing the solution can also be limited. In particular, the outside diameter of the glass can be maximized with respect to the total diameter of the middle thus giving greater freedom in creating the desired overall appearance.

In the invention and in the embodiments, the function of indexing may be carried out by a detent mechanism, such as a click cooperating with notches or teeth.

The invention claimed is:

1. A watch case comprising:

a middle, a bezel mounted to turn on the middle, a ring interfacing between the middle and the bezel and pressing against the bezel and the middle along a direction of an axis of rotation of the bezel on the middle, and a first indexing element and a second indexing element which collaborate in such a way as to index the bezel in position relative to the middle, the watch case comprising a first elastic element pressing the bezel against the middle and a second elastic element pressing the first indexing element against the second indexing element, the ring comprising an opening, wherein the first or the second indexing element extends through the opening from a first face of the ring to a second face of the ring, wherein the first face of the ring faces the middle and the second face of the ring faces the bezel.

2. The watch case as claimed in claim 1, wherein the first elastic element is mounted in one or more housings produced in the middle.

3. The watch case as claimed in claim 1, wherein the first elastic element comprises at least one spring.

4. The watch case as claimed in claim 1, wherein the first indexing element comprises a pawl.

5. The watch case as claimed in claim 4, wherein the pawl is configured in such a way as to provide indexing that allows the bezel to move in one direction or in both directions relative to the middle.

6. The watch case as claimed in claim 1, wherein the second indexing element is secured to the bezel.

7. The watch case as claimed in claim 6, wherein the first indexing element comprises a pawl, and the opening comprises a first shaping collaborating with a second shaping of the pawl so as to prevent the pawl from turning.

8. The watch case as claimed in claim 1, wherein the second elastic element comprises a helical spring.

9. The watch case as claimed in claim 1, wherein the opening opens into the inside diameter or onto the outside diameter of the ring.

10. The watch case as claimed in claim 1, wherein the ring is a spring washer, the spring washer constituting or forming part of the first elastic element.

11. The watch case as claimed in claim 10, wherein the ring when unloaded has a frustoconical shape.

12. The watch case as claimed in claim 11, wherein the ring is mounted bearing against the middle in a groove of the middle, and bearing against an underside of the bezel.

13. The watch case as claimed in claim 1, wherein the ring is fixed to the middle or, respectively, to the bezel, at its inside diameter and bears against the bezel or, respectively, against the middle, at its outside diameter.

14. The watch case as claimed in claim 1, wherein the ring is fixed to the middle or, respectively, to the bezel, at its outside diameter and bears against the bezel or, respectively, against the middle, at its inside diameter.

15. A watch comprising a watch case as claimed in claim 1.

16. The watch case as claimed in claim 1, wherein the first elastic element comprises at least one helical spring.

17. The watch case as claimed in claim 1, wherein the second elastic element comprises a helical spring mounted in a housing in the middle.

18. The watch case as claimed in claim 1, wherein the second indexing element comprises teeth.

19. The watch case as claimed in claim 18, wherein the teeth are configured in such a way as to provide indexing that allows the bezel to move in one direction or in both directions relative to the middle.

20. The watch case as claimed in claim 1, wherein the first indexing element is pressed against the second indexing element along a direction of an axis of rotation of the bezel on the middle.

21. A watch case comprising:

a middle, a bezel mounted to turn on the middle, a ring interfacing between the middle and the bezel and pressing against the bezel and the middle along a direction of an axis of rotation of the bezel on the middle, and a first indexing element and a second indexing element which collaborate in such a way as to index the bezel in position relative to the middle, wherein (i) the bezel is elastically pressed against the middle and (ii) the first indexing element is elastically pressed against the second indexing element, and wherein the ring comprises an opening, wherein at least one of the first indexing element and the second indexing element extends through the opening from a first face of the ring to a second face of the ring, wherein the first face of the ring faces the middle and the second face of the ring faces the bezel.

22. The watch case as claimed in claim 21, wherein the ring is pressed against the bezel by a first elastic element comprising at least one spring.

23. The watch case as claimed in claim 21, wherein the ring is a spring washer, the spring washer constituting or forming part of a first elastic element.

24. The watch case as claimed in claim 21, wherein the first indexing element is pressed against the second indexing element by a second elastic element comprising a helical spring.

25. The watch case as claimed in claim 21, wherein the first indexing element is pressed against the second indexing element along a direction of an axis of rotation of the bezel on the middle.

* * * * *